US005856723A

United States Patent [19]

Rittner

[11] Patent Number: 5,856,723

[45] Date of Patent: Jan. 5, 1999

[54] INCANDESCENT LAMP WITH LOW-BEAM SCREENING CAP

[75] Inventor: Roland Rittner, Herbrechtingen, Germany

[73] Assignee: Patent-Treuhand-Gesellschaft fuer elektrische Gluehlampen mbH, Munich, Germany

[21] Appl. No.: 743,449

[22] Filed: Nov. 1, 1996

[30] Foreign Application Priority Data

Nov. 27, 1995 [DE] Germany ..... 195 44 012.9

[51] Int. Cl.[6] ..... H01K 9/08

[52] U.S. Cl. ..... 313/117; 313/115; 313/272; 313/316

[58] Field of Search ..... 313/117, 115, 313/579, 580, 331, 272, 316

[56] References Cited

U.S. PATENT DOCUMENTS

| | | | |
|---|---|---|---|
| 3,315,112 | 4/1967 | Burnett | 313/115 |
| 3,530,326 | 9/1970 | De Caro | 313/316 |
| 3,824,421 | 7/1974 | Schuringa et al. | 313/110 |
| 3,962,596 | 6/1976 | Drapte | 313/117 |
| 3,988,630 | 10/1976 | Anderson et al. | 313/331 |
| 4,029,985 | 6/1977 | Rachel | 313/115 |
| 4,074,167 | 2/1978 | van der Broek et al. | 313/579 |
| 4,079,283 | 3/1978 | George | 313/113 |
| 4,305,016 | 12/1981 | Schmidt | 313/117 |
| 4,791,333 | 12/1988 | Morris | 313/25 |
| 4,893,050 | 1/1990 | Fields | 313/113 |
| 4,964,829 | 10/1990 | Westlund et al. | 313/113 |
| 5,578,893 | 11/1996 | Yamamoto | 313/112 |

FOREIGN PATENT DOCUMENTS

| | | | |
|---|---|---|---|
| 224 445 A1 | 3/1985 | Germany | H01K 1/48 |

*Primary Examiner*—Frank G. Font
*Assistant Examiner*—Michael Day
*Attorney, Agent, or Firm*—William E. Meyer

[57] ABSTRACT

The invention concerns an electrical incandescent lamp with a low-beam cap, particularly a two-filament halogen incandescent lamp and a production process for such a lamp, as well as a low-beam cap. Low-beam screening cap (12) has an opening (14), through which one end (6*a*) of low-beam filament (6) is threaded. This filament end (6*a*) is welded to the back side of low-beam screening cap (12) or to a current lead wire (8*a*), which is attached by a projection welding to the back side of low-beam screening cap (12). The fastening of low-beam filament (6) according to the invention makes possible materials savings in the case of a low-beam screening cap (12) and lower cost lamp manufacture.

1 Claim, 3 Drawing Sheets

INCANDESCENT LAMP WITH LOW-BEAM SCREENING CAP

1. Technical Field

The invention concerns an electrical incandescent lamp with a low-beam screening cap and a process for the production of an electrical incandescent lamp with a low-beam screening cap as well as a low-beam screening cap for a low-beam filament of an electrical incandescent lamp.

2. Background Art

An incandescent lamp with a low-beam screening cap and a manufacturing process are disclosed, for example, in German Patents DE 2,243,717 and DD 224,445. Patent DE 2,243,717 describes a two-filament halogen incandescent lamp for an automobile headlight. This lamp has a low-beam filament, which is partly screened by a low-beam cap, and a high-beam filament. One end of the low-beam light filament is welded to a current lead wire, while the other end is attached to a flat part of the low-beam screening cap serving for screening the incandescent filament by means of a projection welding.

Patent DD 224,445 also describes a two-filament halogen incandescent lamp. In this lamp, one end of the low-beam filament is inserted into a groove introduced in the flat part of the low-beam screening cap and constricted with a V shape, and welded to a flat part of the low-beam screening cap that does not contribute to screening the incandescent filament.

DISCLOSURE OF THE INVENTION

An electrical incandescent lamp may be manufactured with a lamp bulb enclosing a low-beam spiral filament and a low-beam screening cap partially screening the incandescent filament, wherein the low-beam screening cap has an opening through which one end of the low-beam filament is guided.

BEST MODE FOR CARRYING OUT THE INVENTION

The electrical incandescent lamp according to the invention has a low-beam screening cap provided with an opening for the partial screening of the low-beam filament of the lamp. One end of the low-beam filament is threaded through the opening of the low-beam screening cap and welded to a current lead. The flat part of the low-beam screening cap not contributing to the masking, which is used according to the above-mentioned state of the art for welding one end of the low-beam filament, can be done away with by this structure in the electrical incandescent lamp. This savings in material for the low-beam screening cap enables a lower cost lamp manufacture.

The end of the low-beam filament threaded through the opening is preferably welded to a current lead wire, which in turn is welded to the back side of the low-beam screening cap and bears this cap. The invention can be applied preferably in two-filament halogen incandescent lamps, which may be used in vehicle headlights.

In the process according to the invention for the production of an electrical incandescent lamp with a low-beam filament and with a low-beam screening cap partially masking the low-beam incandescent filament, an opening is produced in the low-beam cap, preferably by means of a laser, through which one end of the low-beam filament coil is threaded. This end of the low-beam filament is then welded to a current lead. This current lead preferably is a current lead wire, which is welded to the back side of the low-beam screening cap and supports the latter. To avoid an increased component of scattered light, the opening in the low-beam screening cap is either sealed preferably after threading the end of the low-beam filament, or the dimensions of the opening are kept so small that unallowable scattered light does not arise.

The low-beam screening cap according to the invention is provided with an opening, which serves for guiding one end of the low-beam filament. This permits a savings on material in the production of the low-beam cap, since the flat part of the low-beam cap, which is used according to the above-mentioned state of the art lamp, for welding to the low-beam filament, is not necessary in the low-beam screening cap of the invention. This flat part of the low-beam screening cap does not contribute to the screening of the low-beam filament. Preferably, the low-beam screening cap comprises a high-melting metal, such as, for example, molybdenum.

Figure 1:
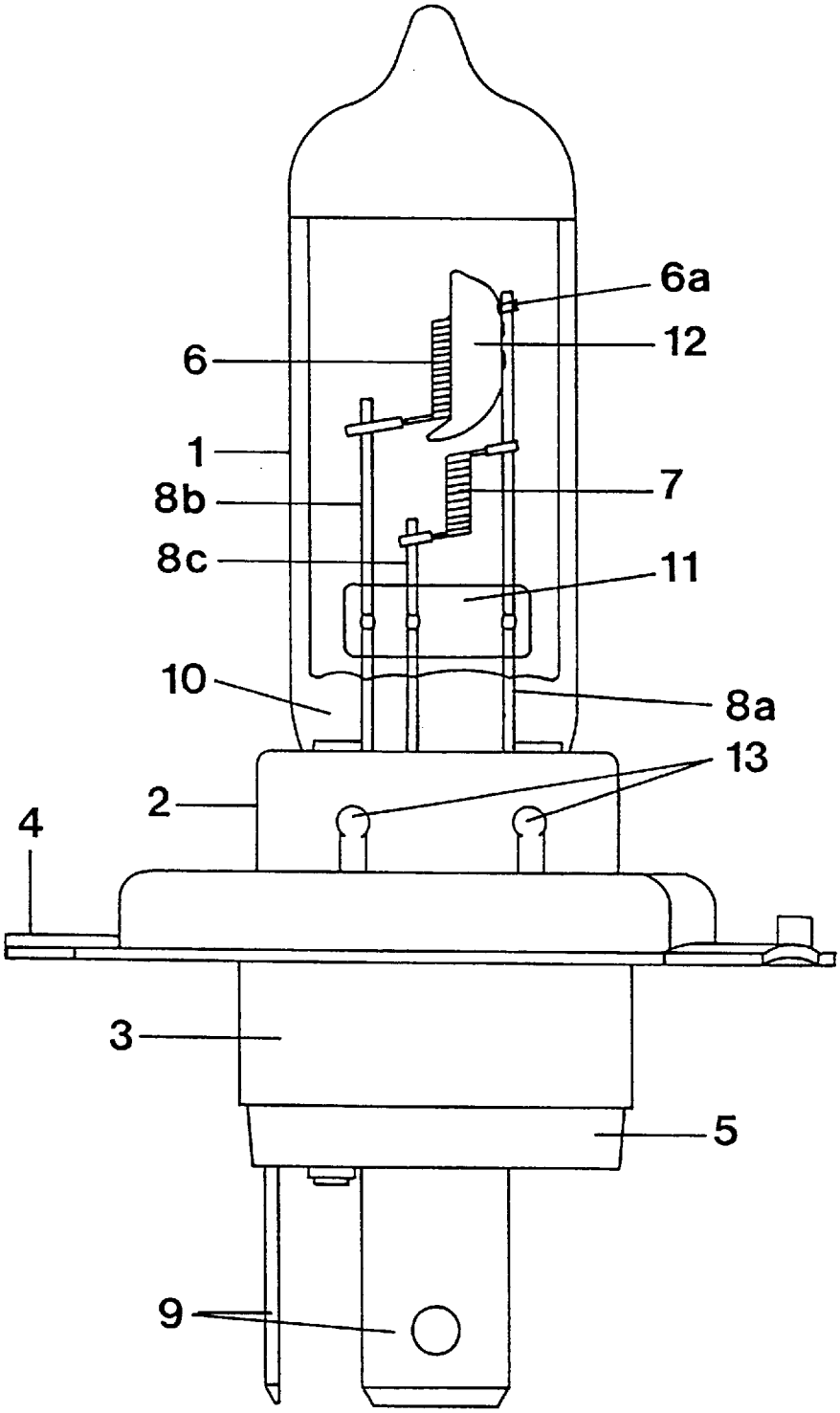
FIG. 1 shows a schematic side view of a preferred embodiment of the electrical incandescent lamp.
Figure 2:
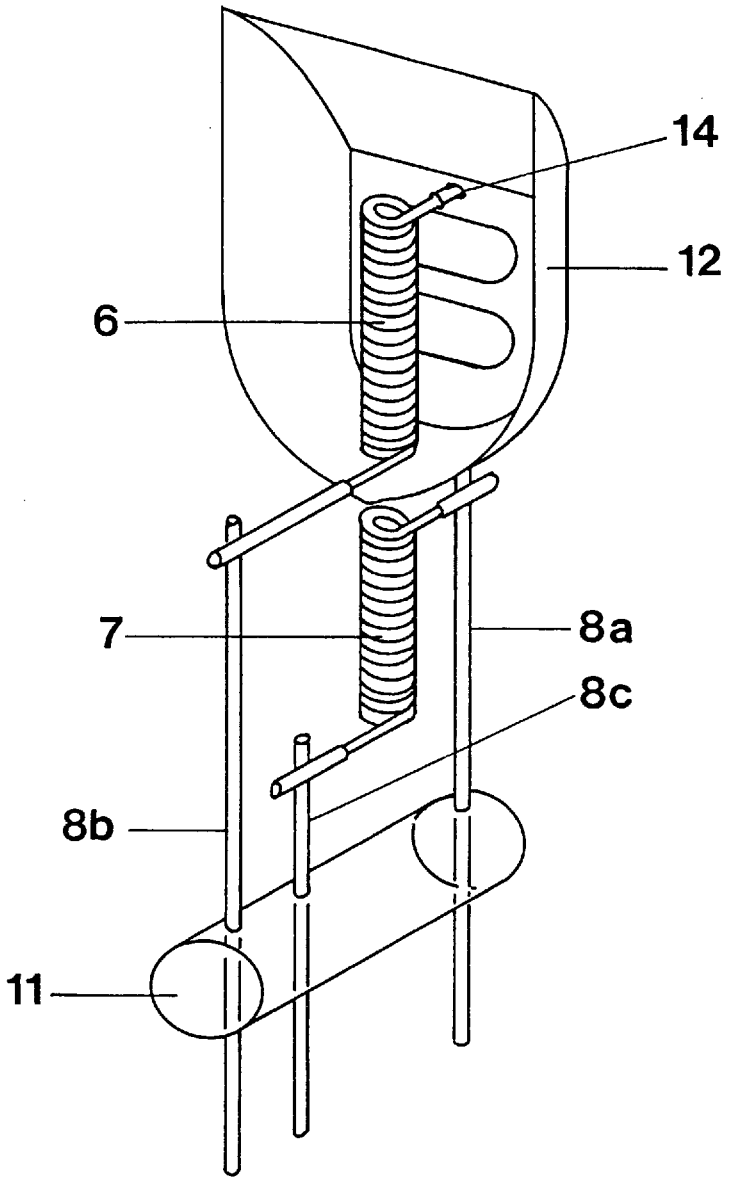
FIG. 2 shows a portion of the front side of the low-beam screening cap of the lamp according to the invention of FIG. 1 with a low-beam filament, a high-beam filament and current leads as well as a quartz cross-piece mount in a schematic perspective representation.
Figure 3:
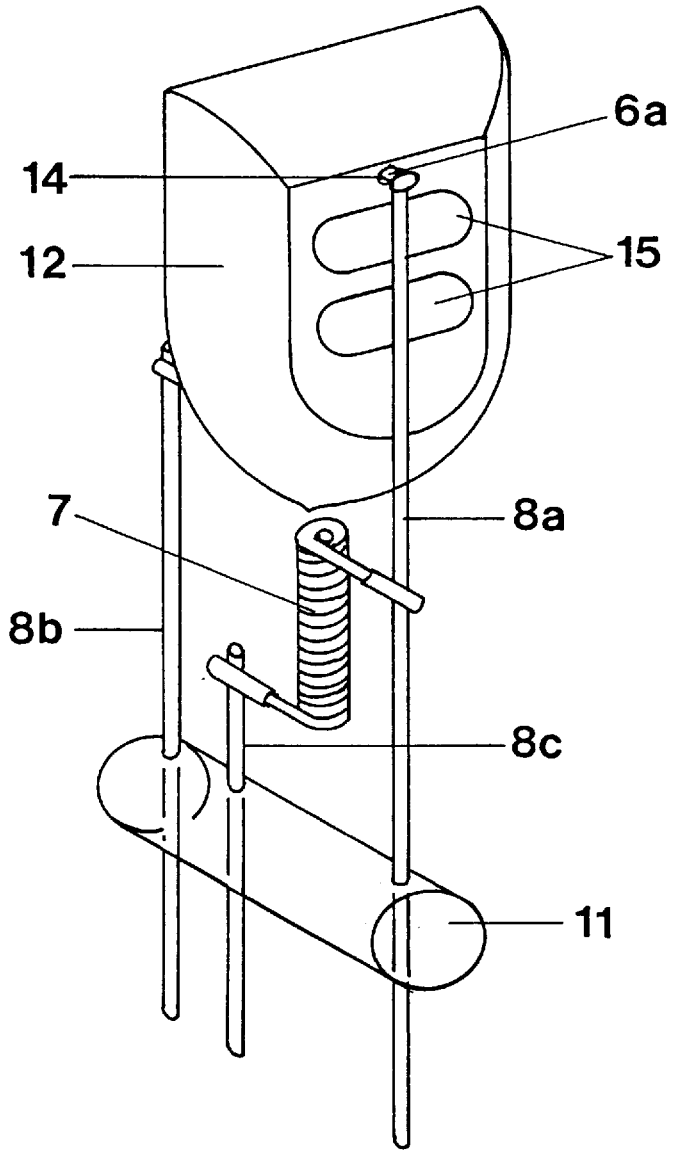
FIG. 3 shows a portion the back side of the low-beam screening cap of the lamp of FIG. 1 with a low-beam filament, a high-beam filament and current leads, as well as the cross-piece mount in a schematic perspective representation.

In the preferred example of embodiment illustrated in FIG. 1, there is a two-filament halogen incandescent lamp for use in a motor vehicle headlight. The halogen incandescent lamp of the invention has a lamp bulb 1 made with the glass pinched tightly on one end. The pinch seal 10 of lamp bulb 1 is clamped into a metal holder part 2, which is usually called as a fix ring. Fix ring 2 forms the lamp socket together with socket sleeve 3 and adjustment plate 4 shaped thereon, as well as with socket insulation 5. Fix ring 2 is welded to adjustment plate 4 by means of weld pieces 13 bent outward and punched out of adjustment plate 4. A low-beam filament 6 and a high-beam filament 7, which are joined together in an electrically conducting manner with a contact piece 9 by means of a total of three current leads 8*a*, 8*b*, 8*c* projecting from pinch seal 10 and fused in a quartz cross-piece mount 11, are found inside lamp bulb 1.

High-beam spiral filament 6 is provided with a low-beam screening cap 12, which partially screens the latter.

Low-beam screening cap 12 consisting of molybdenum is shaped like a trough and is reminiscent of the shape of a boat. The front side of low-beam screening cap 12 is turned toward low-beam spiral filament 6, whereas the back side of low-beam screening cap 12 is joined by means of a projection welding 15 with first current lead 8*a* of low-beam filament 6. Low-beam screening cap 12 has an opening 14 in the vicinity of projection weld point 15, through which one end 6*a* of low-beam filament 6 is threaded. This end 6*a* of the low-beam filament is welded to first current lead 8*a*. The other low-beam filament end is joined with a second current lead 8*b*. Both ends of high-beam filament 7 are welded to first current lead 8*a* of low-beam filament 6 and welded to third current lead 8*c*.

For the production of the lamp according to the invention, prefabricated current lead wires 8*a*, 8*b*, 8*c* are sealed in a quartz cross-piece mount 11 and prefabricated low-beam screening cap 12 is attached to current lead wire 8*a* by projection welding. In addition to current lead wire 8*a,* an opening 14 is produced by means of a laser above projection welding 15 in low-beam screening cap 12, i.e., a hole 14 is drilled, whose diameter is greater than the diameter of filament end 6*a*. End 6*a* of low-beam filament 6 is threaded through opening 14 and is welded on the back side with current lead 8*a*. The other end of low-beam filament 6 is welded to second current lead 8*b*. Further, the ends of high-beam filament 7 are welded to first current lead 8*a* and a third current lead 8*c*. The introduction of the lamp mounting into prefabricated lamp bulb 1 and the subsequent forming of the lamp socket are produced in the usual way and will not be described further here.

The invention is not limited to the example of embodiment explained above in detail. For example, it is not absolutely necessary that end 6*a* of the low-beam filament threaded through opening 14 in the low-beam screening cap is welded to current lead wire 8*a* attached to the back side of low-beam screening cap 12. It is also possible to unwind the filament end 6*a* after threading through hole 14 and to weld it to the back side of low-beam screening cap 12. Filament end 6*a,* however, may also be shortened after threading through hole 14 in low-beam screening cap 12 and the segment of filament end 6*a* projecting over the back side of low-beam screening cap 12 may be fused on, so that filament end 6*a* is welded to low-beam screening cap 12 after the fusion solidifies, whereby the solidified fusion welds the gap remaining between filament end 6*a* and the edge of opening 14. Opening 14 in low-beam screening cap 12 may be produced, for example, also by means of an electron beam, instead of a laser.

The goal of the invention is to prepare a lower cost electrical incandescent lamp with a low-beam screening cap and a production process for such an electrical incandescent lamp, as well as a lower cost low-beam screening cap for the partial screening of the low-beam filament of an electrical incandescent lamp. This goal is achieved according to the invention by the features of claims 1, 5 and 11. Particularly favorable embodiments of the invention are described in the subclaims.

While there have been shown and described what are at present considered to be the preferred embodiments of the invention, it will be apparent to those skilled in the art that various changes and modifications can be made herein without departing from the scope of the invention defined by the appended claims.

What is claimed is:

1. An electrical incandescent lamp comprising: a lamp bulb (1) enclosing a low-beam spiral filament (6) and a low-beam screening cap (12) partially screening the incandescent filament (6), wherein the low-beam screening cap (12) has an opening (14) through which one end (6*a*) of the low-beam filament (6) is guided and electrically coupled to a current lead (8*a*), and wherein the current lead (8*a*) welded to filament end (6*a*) guided through opening (14) is attached to a back side of the low-beam screening cap (12).

* * * * *